United States Patent [19]

Choi

[11] Patent Number: 4,972,754

[45] Date of Patent: Nov. 27, 1990

[54] SYSTEM FOR CONTROLLING OUTPUT OF ELECTRONIC MUSICAL INSTRUMENT

[75] Inventor: Woo-Sung Choi, Suwon, Rep. of Korea

[73] Assignee: SamSung Electronics Co., Ltd., Suwon, Rep. of Korea

[21] Appl. No.: 331,353

[22] Filed: Mar. 31, 1989

[30] Foreign Application Priority Data

May 18, 1988 [KR] Rep. of Korea ..... 1988-5801

[51] Int. Cl.[5] ..... G10H 1/02; G10H 7/00

[52] U.S. Cl. ..... 84/627

[58] Field of Search ..... 84/627, 663

[56] References Cited

U.S. PATENT DOCUMENTS 4,178,826 12/1979 Hiyoshi et al. ..... 84/627

4,628,790 12/1986 Deforeit ..... 84/627 X

*Primary Examiner*—W. B. Perkey

*Attorney, Agent, or Firm*—Robert E. Bushnell

[57] ABSTRACT

The inventive system comprising a memory for storing the ADSR data, a clock controller for selecting the clock pulses, a counter for counting the output of the clock controller, a data switching means for buffering the output data of the memory, a holding means for holding the output of the data switching means, a comparator for comparing the output of the memory with the output of the holding means, and main controller. The main controller inputs a control signal to control the data access time in the memory and the outputs of the switching means and holding means. According to the present invention, the release data are outputted immediately after the putting off of the keyboard signal to produce more accurate ADSR data.

3 Claims, 4 Drawing Sheets

D
11
13
ADDRESS
FFH
00H
7FH
FFH
T

D
11
7FH
12
13
ADDRESS
FFH
Q=H
Q=L
T

D
11
7FH
13
ADDRESS
FFH
7FH
20
22
Q=L
Q=H
T

D
14a
30H
16b
FFH
ADDRESS
91H
14
16
14a
14b
16d
16b
23
24
25
26
27
28
FFH
7FH
00H
30H
7FH
FFH
T
Q=H
Q=L

D
14a
30H
91H
15
16b
FFH
ADDRESS
23
24
26
28
FFH
7FH
00H
30H
91H
FFH
T

SYSTEM FOR CONTROLLING OUTPUT OF ELECTRONIC MUSICAL INSTRUMENT

TECHNICAL BACKGROUND

The present invention concerns a system for controlling Attack-Decay Sustain-Release (ADSR) data output of an electronic musical instrument, and more particularly, a system for controlling the ADSR data output when the keyboard becomes into the off state during the attack data outputting.

Conventionally, an electronic musical instrument has a memory storing the ADSR data for controlling the tone envelope, which ADSR data are controlled to be outputted according to the on and off states of the keyboard of the electronic musical instrument. Such a system of prior art, as shown in FIG. 1, comprises a counter 100 for counting inputted clock pulses CK to output the address data, a memory 200 for storing the address data outputted from said counter 100 to output the ADSR data, a clock pulse controller 300 for receiving a clock pulse CK, the address data of said counter 100 and the keyboard signal, and a latch 400 for latching the output data of said memory 200, said latch being enabled by first control signal of said clock controller 300, said clock controller 300 receiving the keyboard signal Q to supply a reset signal to said counter 100 and then a clock pulse CK thereto, said clock controller cutting off said clock pulse CK to said counter 100 and outputting said first control signal when said counter 100 counts a fixed number of said clock pulses CK, while inputting said clock pulse CK into said counter 100 when said keyboard signal Q is cut off. FIG. 2A illustrates waveforms of the ADSR data output in FIG. 1, wherein FIG. A illustrates the state of the envelope data stored into the memory 200, the data included in the addresses 00–7F in hexadecimal code being the attack data while the data in the addresses 80–FF being the release data, FIG. 2B illustrates the ADSR data outputted from the memory 200 when the keyboard is put on prolonged time maintaining 7F address data waveform, and FIG. 2C illustrates the waveform of the ADSR output when the keyboard is put off in the attack time. In the drawings, the longitudinal axis represents the data level, and the horizontal axis the address concerning time. The reference numeral 11 represents the attack address region, and 13 the release address region. The numeral 12 represents the sustain region, and the numerals 20 and 22 the release data curves. The numeral 20 represents the curve that must be outputted when the keyboard signal Q becomes low during outputting of the attack data.

The operation of the circuit in FIG. 1 will be explained with reference to the waveforms of FIG. 2. During the clock pulse CK being inputted into the clock controller 300, if the keyboard signal Q is inputted as high level, the clock controller 300 supplies a reset signal R to the counter 100 to reset the counter, and outputs the clock pulse CK and the first control signal. Hence, the counter 100 counts the clock pulse CK, inputting the resultant into the memory 200 and the clock controller 300. The memory accesses the data in the location addressed by the output data of the counter 100 to input the envelope data into the latch 400.

In this case, the counter 100 counts the clock pulse from the address 00, while the memory 200 accesses the data according to the address inputted from 00 of the envelope data as shown in FIG. 2A. When the counter 100 outputs the address data within 7F, the memory 200 delivers to the latch 400 the envelope data in the address corresponding to the portion 11 in FIG. 2A. The latch 400 is operated by the first control signal of the clock controller 300 to buffer the envelope data, outputting them through the output line 500. The clock controller 300 receiving the counted data of the counter 100, i.e., the address data of the memory 200, cuts off the clock pulse CK to stop the data access of the memory 200 if the counted data is half 7F the full address FF. Therefore, since the final input data of the latch 400 are outputted through the output line 500, the sustain data are obtained as shown in the portion 12 in FIG. 2B.

During the sustain data being outputted as above, if the keyboard signal becomes low, the clock controller 300 delivers only a fixed number of the clock pulses CK to the counter 100. Hence, the counter 100 sequentially counts the output data of 7F counting as in the series 80, 81 . . . , thereby inputting the address data signals into the memory 200 and the clock controller 300. The memory 200 receiving the data outputted from the counter 100 outputs the release data of the address 80–FF as shown by the portion 13 in FIG. 2A immediately after the sustain portion 12 in FIG. 2B. If due to the clock pulse outputted from the clock controller 300 are outputted the release data (the portion 13 in FIG. 2A) stored into the memory 200, the ADSR data are outputted from the latch as shown in FIG. 2B.

On the other hand, the clock controller 300 receiving the output data of the counter 100 as the address of the memory 200 resets the counter 100 and cuts off the clock pulse CK to stop the output of the ADSR data if the input address becomes the signal indicating the full address FF of the memory 200. In such a system of prior art, while the foregoing operation makes the counter 100 to count the data up to the half address 7F of the full address FF in the active high of the keyboard signal Q as shown FIG. 2C, if the keyboard signal Q becomes low, the counter 100 continuously counts the inputted clock pulses CK from the start address 00 to the full address FF, so that the ADSR waveform which must be outputted as shown by the portion 20 in FIG. 2C is outputted as shown by the portion 22 in FIG. 2C. Consequently, the ADSR waveform of the tone of the electronic musical instrument is not correctly outputted according to the state of touching the keyboard so that the tone quality of the electronic musical instrument is deteriorated.

SUMMARY OF THE INVENTION

It is an object of the present invention to provide a system for controlling the ADSR data output of an electronic musical instrument which correctly outputs the ADSR by controlling the envelope data outputted from the memory depending on the state of touching the keyboard.

According to the present invention, a system for controlling the ADSR data output of an electronic musical instrument comprises a memory for storing said ADSR envelope data into predetermined address locations, a clock controller for selecting one of first and second clock pulses to output or block it according to a control signal of selecting said clock pulse, said first clock pulse having the frequency higher than that of said second clock pulse, a counter for counting the output of said clock controller to provide the access address data of said envelope data of said memory, a data switching means for buffering the output data of said memory according to the first control signal, a holding means for holding the output of said data switching means by said first control signal, a comparator for comparing the output of said memory with the output of said holding means according to second control signal, and main controller for producing a reset signal to reset said clock controller, counter, holding means and comparator and for inputting a control signal into said clock controller to control the data access time in said memory and the outputs of said switching means and holding means, said main controller having a plurality of input terminals for start signal, keyboard signal, address data, and compared signal and a plurality of output terminals for control signal of selecting clock pulse, first, second, third, and fourth signals, said reset signal being outputted through the output terminals for said third and fourth control signal when said start signal is inputted into said main controller, said control signal being inputted into said clock controller according to the signals inputted through the input terminals for said keyboard signal, address data and compared signal.

BRIEF DESCRIPTION OF THE DRAWINGS

For a better understanding of the invention and to show how the same may be carried into effect, reference will now be made, by way of example, to the accompanying diagrammatic drawings, in which.

DETAILED DESCRIPTION OF THE INVENTION

The present invention will now be described specifically with reference to the drawings attached only by way of example.

Figure 3:
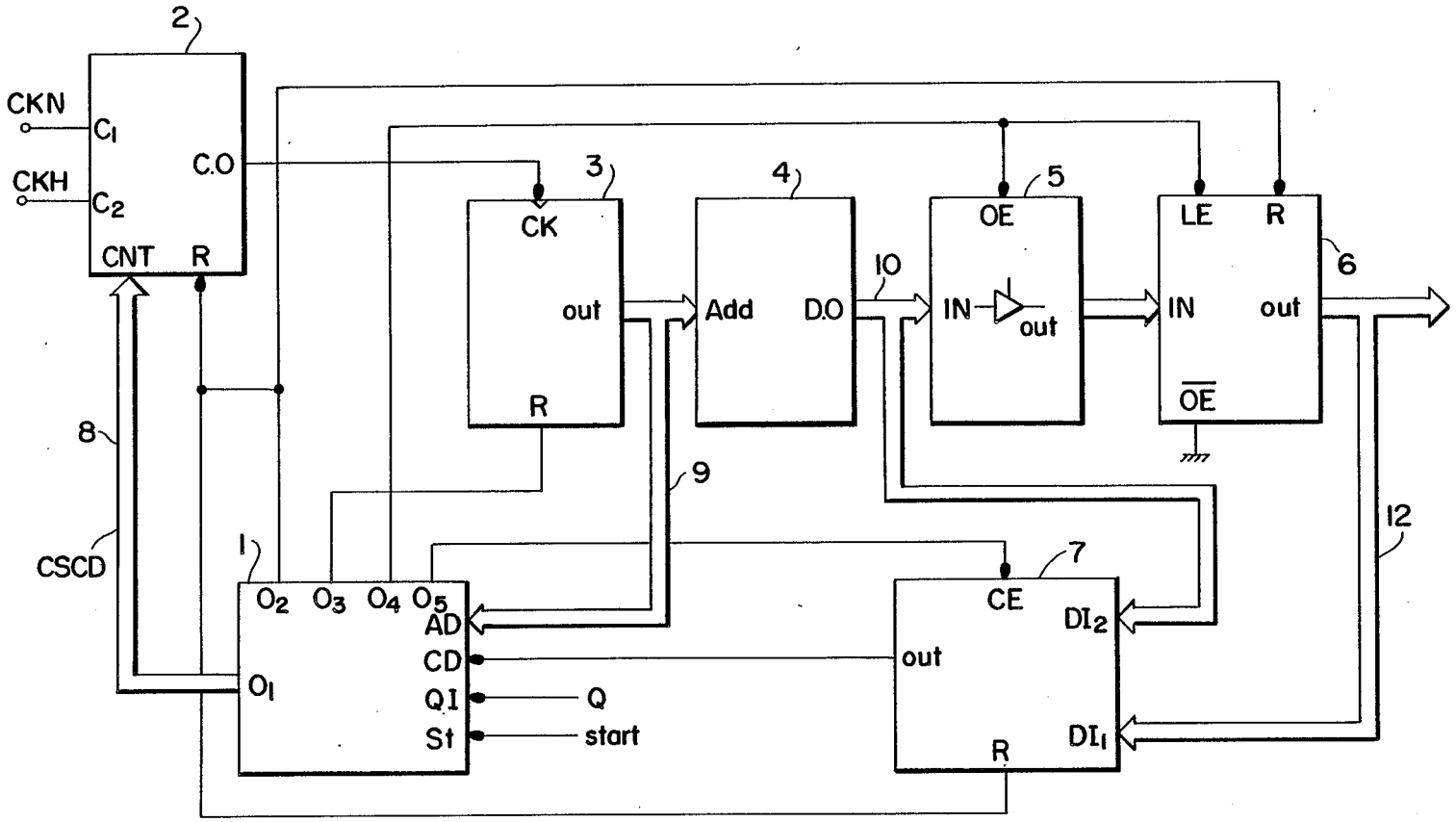
FIG. 3 illustrates the inventive circuit.

Referring to FIG. 3, the system of the present invention comprises main controller 1 for controlling the whole system, clock controller 2, counter 3, memory 4, buffer 5, latch 6 and comparator 7. The main controller 1 has a plurality of input terminals QI, St, AD, CD for keyboard signal (Q) start signal (start), address data and compared data respectively, and a plurality of output terminals O1–O5 to control the system. The clock controller 2 selects the normal clock pulse CKN or the high clock pulse CKH according to control data CSCD for selecting the clock pulses, which are generated by the main controller 1. The counter 3 counts the clock pulses outputted from the clock controller 2 to deliver address data to the memory 4 and the main controller 1. The memory 4 stores the envelope data and accesses the data according to the address data counted by the counter 3. The buffer 5 is enabled by the main controller 1 to buffer the data outputted from the memory 4. The latch 6 is controlled by the main controller 1 to latch the data outputted from the buffer 5. The comparator 7 is controlled by the main controller 1 to compare the output data of the memory 4 with the output data of the latch 6, inputting the resultant into the main controller 1.

Figure 4:
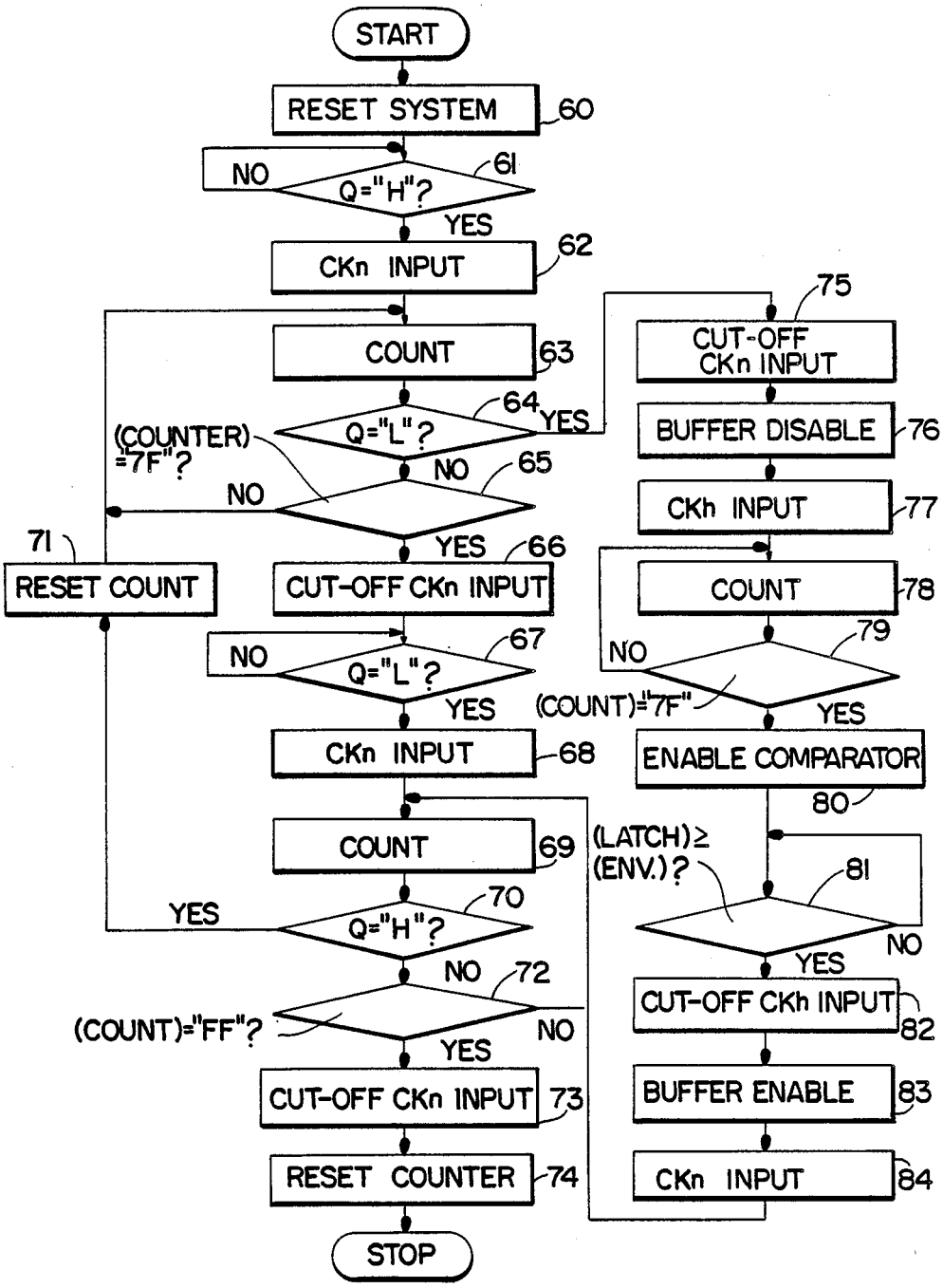
FIG. 4 is the operational flow chart of FIG. 3.

The inventive system is operated in the sequence as shown in FIG. 4. The operational steps are as follows:

STEP 1. When the keyboard signal Q is on 61, the normal clock pulse CKN is inputted 62 and counted 63. Then, it is detected if the keyboard signal Q is off 64.

STEP 2. When the keyboard signal Q continues to be on 64, the normal clock pulse CKN is counted up 65 to the end of the attack waveform data of the envelope data and cut off 66. Then is detected if the keyboard signal Q is off 67.

STEP 3. When the keyboard signal Q is off 68, the normal clock pulse is counted 69 to provide the address for outputting the release waveform data of the envelope data. Then is detected if the keyboard signal Q is on 70.

STEP 4. When the keyboard signal Q is on 70, the counter is reset 71 to provide the address. Then is performed the STEP 1 63.

STEP 5. When the keyboard signal Q is off 70 in the STEP 3, it is detected 72 if the data to provide the address are counted to the full address. Then, if the counting is completed, the clock pulse is cut off 73 and the count is reset 74. However, if the counting is not completed, there is continuously performed the counting operation 69 to provide the address in the STEP 3.

STEP 6. When the keyboard signal Q is off 64 in the STEP 2, the normal clock pulse is cut off 75 and the output buffer of the memory is disabled 76. Then is counted the high clock pulse to provide the addres 77, 78.

STEP 7. The counting operation of the step 6 is performed to the half address of the envelope data 79. Then is enabled the comparator 80 receiving the output of the latch which holds the half address data of the envelope data and the final output data.

STEP 8. When the latch data is greater than the envelope data 81 presently outputted, the comparator cuts off the high clock pulse 82 and enables the buffer 83. Then is inputted the normal clock pulse 84 to perform the counting for providing the address in the STEP 3.

Figure 1:
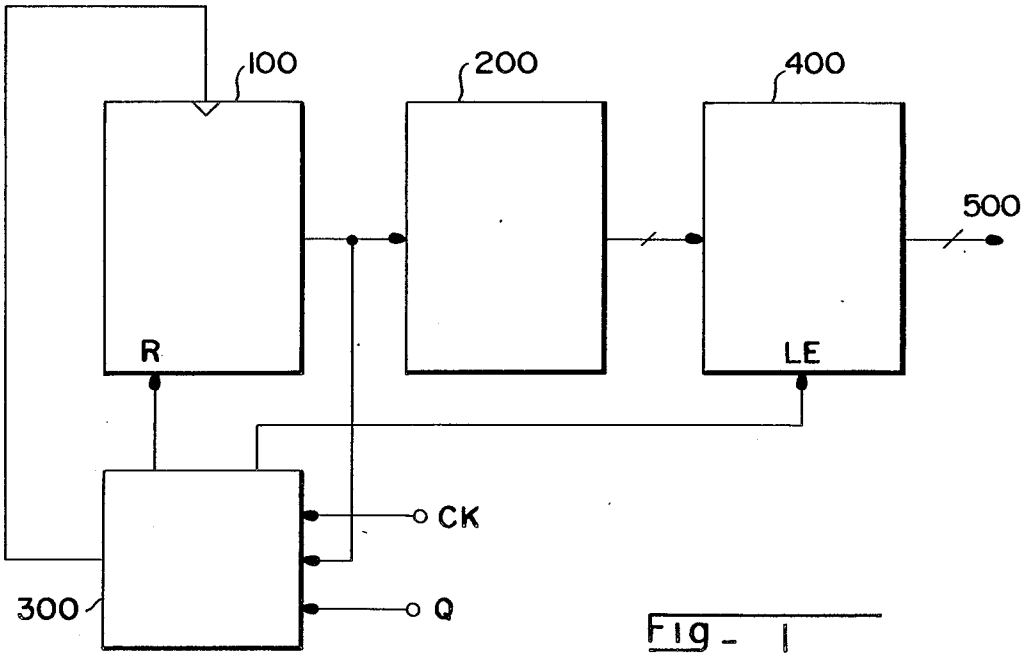
FIG. 1 illustrates a conventional circuit for controlling the ADSR data output of an electronic musical instrument.
Figures 2A, 2B, 2C, 5A, 5B:
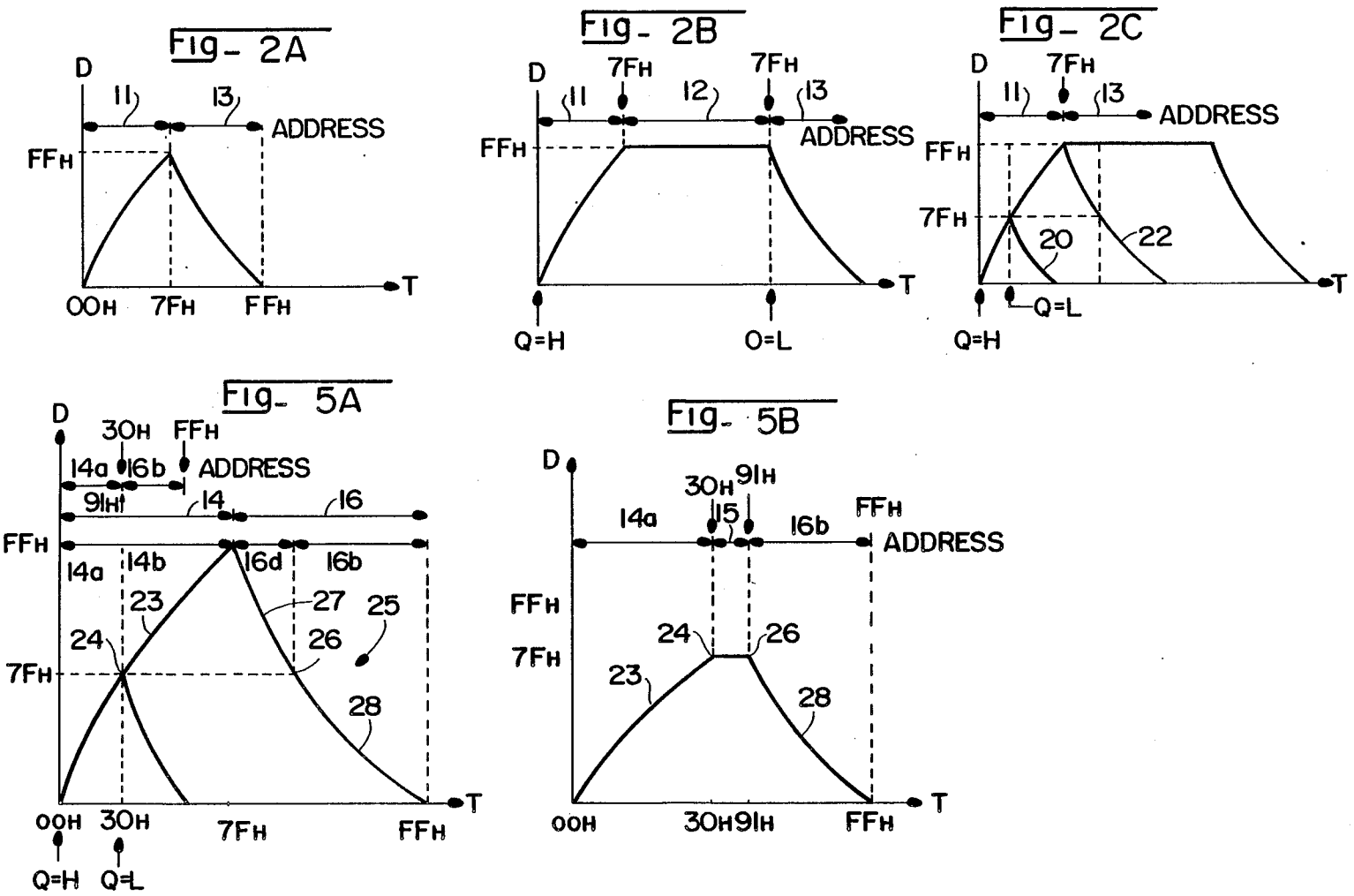
FIGS. 2A–2C illustrate the waveforms of the ADSR output of FIG. 1.
FIG. 5A and 5B illustrate the waveforms of the ADSR output of FIG. 3.

FIG. 5 illustrates the waveforms of the ADSR output of FIG. 3. FIG. 5(5A) is the envelope waveform, as shown in FIG. 2A. FIG. 5(5B) is an enlargement of a part of FIG. 5(5A). The longitudinal axes of FIG. 5 represent the data levels, and the horizontal axes the time and address regions. The reference numerals 23 and 25 in FIG. 5 indicate respectively the output curves of the attack and release data. The reference numeral 14 including **14*a* and 14*b* indicates the attack address region, and the reference numeral 16 including 16*a* and 16*b*** the release address region.

The operation of the inventive system as shown in FIG. 3 will be described with reference to FIGS. 4 and 5. It is assumed that the data of the attack and release waveforms are stored into the memory 4 respectively by the addresses 00H–7FH and 80F–FFH. If the start signal is inputted through the start terminal St, the main controller 1 outputs high signal through the output terminals O2 and O3 to reset the clock controller 2, counter 3, latch 6 and comparator 7, and detects the input terminal QI of the keyboard signal (the step 61 in FIG. 4). If the keyboard signal Q of high state is inputted into the input terminal QI, the main controller 1 delivers the control data CSCD for selecting the clock pulse to the clock controller 2 through the output terminal O1 to select the normal clock pulse CKN, and outputs a control signal through the output terminal O4 to enable the buffer 5 and latch 6.

Hence, the clock controller 2 receives the normal clock pulse CKN (62 in FIG. 4) supplied to the clock terminal CK of the counter 3, which counts the inputted normal clock pulse CKN (63 in FIG. 4). The counter 3 performs n bit binary counting to input the counted data increasing from 00H into the memory 4, and into the input terminal AD for the address data of the main controller 1 through the bus 9. Thus, the memory 4 storing the data of the attack waveform from 00H to the half address 7FH as shown by the portion 14 in FIG. 5(1A) accesses the attack waveform data 23 of the envelope data from the address 00H depending on the inputted data, delivering the data to the enabled buffer 5. Meanwhile, the main controller 1 receiving the address data outputted from the counter 3 detects the keyboard signal Q inputted through the input terminal QI (64 in FIG. 4). If the keyboard signal Q is not low, it is detected whether the counted data inputted through the terminal AD is 7FH (65 in FIG. 4). Then, if the counted data is not 7FH, the main controller 1 produces the control data CSCD for selecting the clock pulse through the bus 8 to continue the counting operation. Thus, the attack waveform data of the envelope stored into the memory 4 by the address region 00H–7FH are accessed and inputted through the buffer 5 into the latch 6 which latches the data by the latch enable terminal LE thereby outputting them by the output enabling signal OE.

As described above, if the counter 3 counts the data to the address 7F, the main controller 1 delivers according to the output of the counter 3 to the clock controller 2 through the terminal O1 the control data CSCD for selecting the clock pulse to cut off the normal clock pulse CKN. Thus, the clock controller 2 cuts off the normal clock pulse CKN (66 in FIG. 4) to stop the counting operation of the counter 3, so that no more address data are inputted into the memory 4. Then, the main controller 1 detects if the keyboard signal Q is low (67 in FIG. 4). If the keyboard signal Q continues to be in the high state, the counter 3 is stopped in present state, and the latch 6 latches the data of the address 7FH. The output of the latch represents the sustain in FIG. 2B. In this case, if the keyboard signal Q inputted through the input terminal QI becomes low, the main controller 1 produces the control data CSCD for selecting the clock pulse through the output terminal O1 to select the normal clock CKN. Hence, the clock controller 2 receives the normal clock pulse CKN (68 in FIG. 4), and therefore, the counter 3 continues its counting from the 7FH counting state (69 in FIG. 4).

By the counted data outputted from the counter 3 accesses the memory 4 the release data for the address data inputted as shown by the portion 16 in FIG. 5(5A), thereby outputting the data to the enabled buffer 5 and latch 6. In this state, the main controller 1 detects the keyboard signal Q (70 in FIG. 4). If the keyboard signal Q is high, the main controller 1 outputs through the output terminal O3 the reset signal to reset the counter 3, and the output of the clock controller 2 is counted from 00H to repeat the above operation. If the keyboard signal Q is low, the main controller 1 detects if the output of the counter 3 inputted through the input terminal AD of the address data is the data counted to the full address FF (72 in FIG. 4). If the counted data is not FFH, the main controller 1 controls the clock controller 2 to make the counter 3 continue to operate until the counted data become the full address FFH of the envelope data. If the counter 3 counts the data to the full address, the main controller 1 outputs through the terminal O1 the control data CSCD for selecting the clock pulse to cut off the normal clock pulse CKN, and the reset signal through the output terminal O3. Then, the clock controller 2 cuts off the normal clock pulse CKN (73 in FIG. 4), and the counter 3 is reset. Hence, the ADSR is outputted as shown in FIG. 2.

On the other hand, if the keyboard signal Q is high, the main controller 1 controls the clock controller 2 to deliver the normal clock pulse CKN to the counter 3. Here, when the attack data of the address 30H in the address region 14*a* of the memory 4 are outputted to the data 7EH in the region 24 as shown in 5(1A), and then, the keyboard signal Q becomes low, the main controller 1 delivers the control data CSCD for selecting the clock pulse to cut off the normal clock pulse, and outputs the low signal through the output terminal O4.

Thus, the clock controller 2 cuts off the normal clock pulse CKN (75 in FIG. 4), and the main controller disables the buffer 5 and latch 6 (76 in FIG. 4). Thereafter, the main controller 1 outputs through the output terminal O1 the control data CSCD for selecting the clock pulse to select the high clock pulse CKH inputted into the clock controller 2 (77 in FIG. 4). The counter 3 counts the high clock pulse CKH outputted through the output terminal CO of the clock controller 2 to output with high speed the address data of the portion 14*b* as shown in FIG. 5(5A) (78 in FIG. 4), and the main controller 1 which has outputted the control data CSCD for selecting the clock pulse detects the signal inputted through the input terminal AD to determine if the output data of the counter 3 have been counted up to the half address 7FH of the envelope data (19 in FIG. 4). If the signal inputted through the input terminal AD is not the signal counted to the half address 7FH which is half the full address FFH of the memory 4, the main controller 1 controls the clock controller 2 for the above counting operation to be continued. On the contrary, if the counting is accomplished to the half address 7F, the main controller 1 outputs a control signal through the output terminal O5 to enable the comparator 7. Then, the comparator 7 compares the final output data of the latch (the data in the address region 30H) inputted through the input terminal DI1 with the data presently outputted from the memory 4 (the data in the address region 7FH outputted from the memory 4 by the high clock pulse CKH counting of the counter 3) to output through the output terminal OUT the resultant data to the input terminal CD for the compared data of the main controller 1.

By the resultant data detects the main controller 1 if the data of the latch 6 is greater than the data presently outputted from the memory 4 (81 in FIG. 4). If the data of the memory 4 is greater than the data of the latch 6, the data of the memory 4 is obtained by accessing a portion 27 of the envelope data 25 shown in FIG. 5(5A). In this way, if the output data of the memory 4 represents the envelope data 26 as shown in FIG. 5(5A), namely, the counter 3 counts the high clock pulse CKH of the clock controller 2 to output the signal of the address 91H so that the memory 4 outputs the envelope data 26 shown in FIG. 5(5A), the comparator 7 compares the output of the latch 6 holding the envelope data 24 shown in FIG. 5(5A) with the output data of the memory 4, inputting the resultant as the high signal into the main controller 1. By the main controller 1 receiving the resultant, if it is detected that the output data of the latch 6 is greater than the output data of the memory 4, the main controller 1 outputs through the output terminal O1 the control data CSCD for selecting the clock pulse to cut off the high clock pulse CKH, and through the output terminal 04 a control signal of high state. Hence, the clock controller 2 is controlled by the main controller 1 to cut off the high clock pulse CKH (82 in FIG. 4), and the buffer 5 and latch 6 are enabled (83 in FIG. 4).

After delivering the enabling signal, the main controller 1 outputs to the clock controller 2 the control data CSCD for selecting the normal clock pulse CKN. (84 in FIG. 4). Hence, the clock controller 2 inputs the normal clock pulse CKN into the counter 3, which resumes the counting operation from the counting state 91H to supply the address to the memory 4. By the address signal inputted from the input address 91H, the memory 4 accesses the envelope data to output it to the output bus through the enabled buffer 5 and latch 6. Hence, referring to FIG. 5(5A), when the attack envelope data 23 of the address region 14*a* are outputted to the point 24, and then, the keyboard signal Q becomes off, the ADSR data are outputted from the point 26 of the release envelope data 25 of the address region 16*b*, thereby resulting in correction of the ADSR data.

Referring to FIG. 5(5B) to illustrate the above state more detailedly, though there is a gap 15 between the output address region 30H of the attack envelope data and the output address region 91 of the release envelope data, it can be varied according to the frequency of the high clock pulse CKN, being neglected because of its shortness of time.

Conclusively, according to the present invention, if the keyboard signal becomes off during the attack envelope data being outputted, the attack envelope data presently outputted are held in a fixed state, the attack and release data are quickly outputted, approaching the true value until the level of the attack envelope data and the level of the memory envelope data become equal to each other, and the normal release function are performed when the data levels are equal to each other. Thus, the release data are outputted immediately after the putting off of the keyboard signal to produce more accurate ADSR data, so that the performance of the electronic musical instrument is improved.

The foregoing description shows only a preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A system for controlling Attack Decay Sustain Release data output of an electronic musical instrument having a memory for storing said ADSR envelope data into predetermined address locations, comprising:

a clock controller for selecting one of a first and second clock pulses to output the selected pulse and to block the unselected pulse according to a control signal for selecting said clock pulse, said first clock pulse having a frequency higher than that of said second clock pulse;

a counter for counting the output of said clock controller to provide the access address data of said envelope data of said memory;

a data switching means for buffering the output data of said memory according to a first enable signal;

a holding means for holding the output of said data switching means according to by said first enable signal;

a comparator for comparing the output of said memory with the output of said holding means according to a second enable signal, and a main controller for producing a first reset signal to reset said clock controller, said holding means and said comparator and a second reset signal to reset said counter and for providing said control signal to said clock controller, said main controller having a plurality of input terminals including input terminals for a start signal, a keyboard signal, an address data signal, and a compared data signal, said first and second reset signals being outputted when said start signal is inputted into said main controller, said control signal being inputted into said clock controller according to the signals inputted through the input terminals for said keyboard signal, address data and compared signal.

2. A system for controlling ADSR data output of an electronic musical instrument as claimed in claim 1, wherein said main controller, according to the on signal of said keyboard, inputs the control signal for selecting said first clock pulse into said clock controller, delivers said first enable signal to said switching means and said holding means to output the data accessed in said memory, cuts off the clock pulse inputted into said clock controller when the address inputted is greater than the half address of said memory, and according to the off signal of said keyboard inputs the control signal for selecting said first clock pulse into said clock controller to access the data of said memory.

3. A system for controlling ACSR data output of an electronic musical instrument as claimed in claim 2, wherein said main controller, receiving the address increasing from the address state below the half address of said memory, inputs the control signal for selecting said second clock pulse into said clock controller according to receipt of an off signal at said keyboard signal input terminal and cuts off said first enable signal inputted into said switching means and holding means to obtain high speed input of the address into said memory, and inputs said second enable signal into said comparator when the input address of said memory exceeds the half address so that the data outputted from said memory with high speed and the output data of said holding means are compared with each other, said controller thereafter making said control signal for selecting said first clock pulse when the output data of said memory and the output data of said holding means equal each other, and inputs said first enable signal into said switching means and holding means to produce the access data of said memory.

* * * * *